US006112711A

United States Patent [19]

Shimizu et al.

[11] Patent Number: 6,112,711

[45] Date of Patent: Sep. 5, 2000

[54] VALVE PERFORMANCE CONTROL APPARATUS FOR INTERNAL COMBUSTION ENGINES

[75] Inventors: Koichi Shimizu, Toyota; Hiroyuki Kawase, Okazaki; Yuichi Sakaguchi, Nagoya; Hiromasa Suzuki; Yuji Yoshihara, both of Toyota, all of Japan

[73] Assignee: Toyota Jidosha Kabushiki Kaisha, Toyota, Japan

[21] Appl. No.: 08/971,577

[22] Filed: Nov. 17, 1997

[30] Foreign Application Priority Data

Nov. 18, 1996 [JP] Japan ..... 8-306523

[51] Int. Cl.[7] ..... F01L 13/00; F02D 13/02

[52] U.S. Cl. ..... 123/90.16; 123/90.39; 123/90.22

[58] Field of Search ..... 123/90.12, 90.15, 123/90.16, 90.17, 90.22, 90.39, 90.4, 90.44

[56] References Cited

U.S. PATENT DOCUMENTS

| | | | |
|---|---|---|---|
| 5,046,462 | 9/1991 | Matayoshi et al. | 123/90.16 |
| 5,251,586 | 10/1993 | Koga et al. | 123/90.16 |
| 5,301,636 | 4/1994 | Nakamura | 123/90.16 |
| 5,435,276 | 7/1995 | Nakamura et al. | 123/90.16 |
| 5,669,342 | 9/1997 | Speil | 123/90.16 |
| 5,685,264 | 11/1997 | Allen et al. | 123/90.16 |

FOREIGN PATENT DOCUMENTS

| | | |
|---|---|---|
| 2 653 164 | 4/1991 | France . |
| 2 709 149 | 2/1995 | France . |
| 62-121812 | 6/1987 | Japan . |
| 3-004730 | 2/1991 | Japan . |
| 3-130509 | 6/1991 | Japan . |
| 3-267515 | 11/1991 | Japan . |
| 2 254 109 | 9/1992 | United Kingdom . |

*Primary Examiner*—Weilun Lo
*Attorney, Agent, or Firm*—Pillsbury Madison & Sutro LLP

[57] ABSTRACT

A valve performance control apparatus has a low speed cam, a high speed cam, and an intermediate speed cam. A rocker arm is arranged between the cams and a valve. The rocker arm contacts the low speed cam. A pair of cam followers are reciprocally supported in the rocker arm to contact the high speed and intermediate speed cams. Lock members are slidably received in bores (or grooves) of the rocker arm. The lock members, when positioned in an unlocked position, permit the free reciprocation of the associated cam followers with respect to the rocker arm, which causes the valve to be driven by the low speed cam. When locked, the lock members abut against the associated cam followers and lock the cam followers to the rocker arm, which causes the valve to be driven by the cam with the largest profile. The lock member has an abutment surface, which contacts and is pressed by the cam follower. The bore has a supporting wall for supporting the lock member opposite to the abutment surface when the abutment surface of the lock member is positioned in the lock position and is pressed by the cam follower. The lock member is not subjected to bending or shear, which improves the reliability of the apparatus.

17 Claims, 8 Drawing Sheets

VALVE PERFORMANCE CONTROL APPARATUS FOR INTERNAL COMBUSTION ENGINES

BACKGROUND OF THE INVENTION

The present invention relates to an apparatus for internal combustion engines that variably controls valve timing and valve lift.

Devices that vary the valve lift or valve timing of intake valves and exhaust valves in automobile engines are known in the prior art. For example, Japaneses Utility Model Publication No. 3-4730 describes an apparatus that drives a rocker arm using a high speed cam and a low speed cam.

The rocker arm has two arm portions. The first arm portion is provided with a shifting mechanism that selectively locks or unlocks the first arm portion with respect to a plunger. The plunger follows a high speed cam. The second arm portion follows the low speed cam. The low speed cam has a lift portion (cam nose), the radius of which is smaller than the radius of the lift portion of the high speed cam. When the plunger is locked to the first arm portion by the shifting mechanism, the low speed cam and the second arm portion are separated from each other. Thus, the motion of the low speed cam is not transferred to the second arm portion. The motion of the high speed cam moves the plunger and the second arm portion, which is integrally locked to the plunger. This drives the rocker arm and opens or closes a valve.

When the shifting mechanism unlocks the plunger and permits the plunger to move freely, the motion of the high speed cam is transferred to the plunger but not the rocker arm. Hence, the low speed cam drives the rocker arm and opens or closes the valve.

A typical shifting mechanism will now be described with reference to FIG. 12. As shown in the drawing, a rocker arm 1 is fixed to a rocker shaft 2. The rocker arm 1 includes a rod 3, which is driven by hydraulic pressure. A plate-like lock member 4 is secured to the distal end of the rod 3. A slit 4*a* bifurcates the distal end of the lock member 4. The rocker arm 1 is further provided with a cylindrical guide 7. A plunger 5 is inserted into the guide 7 and is supported so that it is axially movable. The lock member 4 can be moved into the path of the plunger 5. The guide 7 is provided with an elongated hole 7*a* to receive the lock member 4. The lock member 4 is received by the elongated hole 7*a* when extended into the path of the plunger 5.

When the rod 3 is projected by hydraulic pressure, the lock member 4 moves above the plunger 5 and engages the top surface of the plunger 5. Thus, the upward movement of the plunger 5 is restricted and the plunger 5 is held below the lock member 4. As a result, the plunger 5 and the rocker arm 1 are rocked integrally with each other by a high speed cam (not shown). This causes the rocker arm 1 to lower a poppet valve 6.

When hydraulic pressure is not applied to the rod 3, the rod 3 is moved toward the left from the position shown in FIG. 12. As a result, the lock member 4 moves out of the path of the plunger 5. This permits the plunger 5 to move axially with respect to the locker arm 1. In this state, the plunger 5 is moved axially by the motion of the high speed cam while the rocker arm 1 is driven by a low speed cam (not shown).

The lock member 4 that locks the plunger 5 is a flat plate. To receive the lock member 4 when the lock member 4 extends into the path of the plunger 5, the guide 7 must be provided with the elongated hole 7*a*. However, the machining of the elongated hole 7*a* in the guide 4 is burdensome. Furthermore, it is difficult to accommodate the shifting mechanism entirely in the rocker arm 1.

The lock member 4 is moved into the path of the plunger 5 to lock the plunger 5 to the rocker arm 1. In this state, the force of the plunger 5 is transmitted to the rocker arm 1 through the lock member 4. In other words, the plunger 5 applies a shearing force to the lock member 4. Therefore, the lock member 4 must have sufficient strength to withstand this force. As a result, the thickness of the lock member 4 must be increased. This enlarges the size and increases the weight of the shifting mechanism.

SUMMARY OF THE INVENTION

Accordingly, it is an objective of the present invention to provide a valve performance control apparatus that is machined in a facilitated manner and that is compact and light.

To achieve the above objective, the present invention provides an apparatus for controlling valve performance in an engine. The engine includes a valve for opening and closing a combustion chamber. The valve is variably actuated such that at least one of a valve lift amount and a valve timing is varied. The apparatus comprises at least two cams for selectively opening and closing the valve. The cams include a first cam and a second cam. The first cam has a profile that is different from that of the second cam. A rocker arm is arranged between the cams and the valve to transmit the motion of each cam to the valve. The rocker arm has a contacting member for contacting the first cam. A cam follower is reciprocally supported in the rocker arm to contact the second cam. The cam follower reciprocates axially. A lock member is supported in the rocker arm and is movable in a direction transverse to the axial direction of the cam follower. The lock member has an abutment surface that is movable between a first position spaced from the path of movement of the cam follower and a second position located in the path of movement of the cam follower. The lock member permits the reciprocation of the cam follower with respect to the rocker arm so that the valve is driven by the first cam through the rocker arm when the lock member is positioned in the first position. The lock member abuts against the cam follower and locks the cam follower to the rocker arm to drive the valve by the second cam through the cam follower and the rocker arm when the lock member is positioned in the second position. A supporting surface is provided on the rocker arm to support the lock member when the abutment surface of the lock member is positioned in the second position and is pressed by the cam follower. The supporting surface is located opposite to the abutment surface with respect to the lock member.

Other aspects of the present invention will become apparent from the following description taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 1(*b*) is a cross-sectional plan view showing the valve performance control apparatus of FIG. 1(*a*);

FIG. 2(*b*) is a plan cross-sectional view showing the valve performance control apparatus of FIG. 2(*a*);

FIG. 9(*b*) is a cross-sectional plan view showing the valve performance control apparatus of FIG. 9(*a*);

FIG. 10(*b*) is a cross-sectional plan view showing the valve performance control apparatus of FIG. 10(*a*);

DETAILED DESCRIPTION OF THE PREFERRED EMBODIMENTS

A first embodiment of a valve performance control apparatus according to the present invention will now be described with reference to FIGS. 1 to 7.

Figure 3:
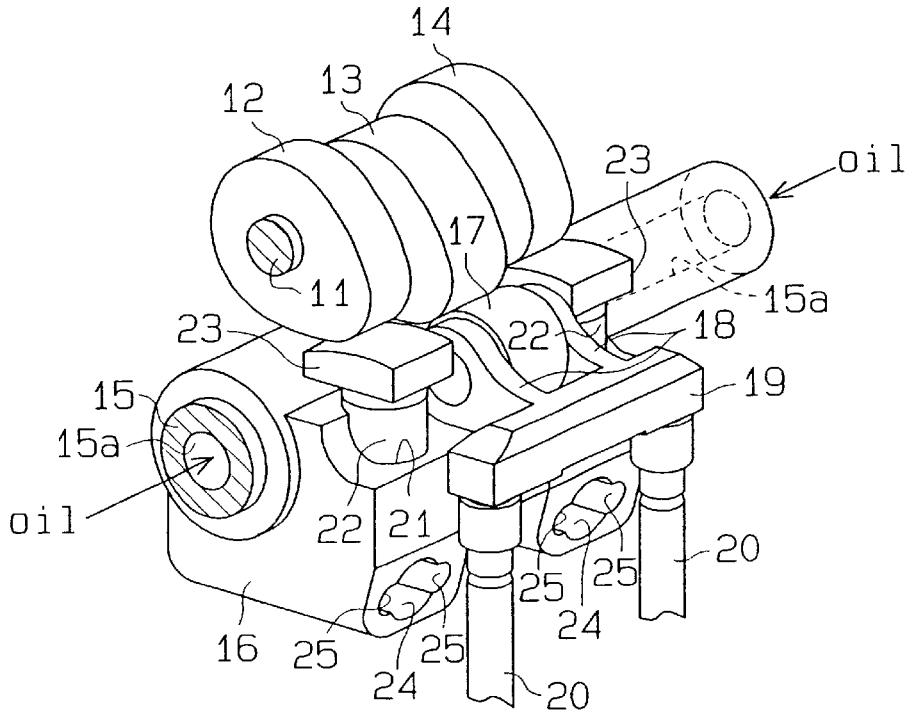
FIG. 3 is a perspective view showing the valve performance control apparatus.
Figure 4:
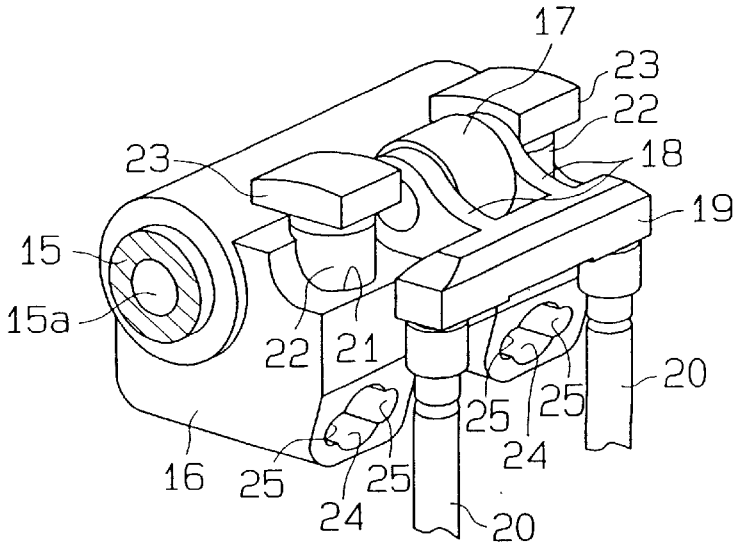
FIG. 4 is a perspective view showing the valve performance control apparatus of FIG. 3 without the cam.

As shown in FIG. 3, a camshaft 11 for intake valves is provided with a low speed cam 13, an intermediate speed cam 12, and a high speed cam 14 for each cylinder (not shown) of the engine. The low speed cam 13 is arranged between the intermediate speed cam 12 and the high speed cam 14. A pair of intake valves 20 open and close the combustion chamber of each cylinder. The low speed cam 13 is used to drive the intake valves 20 when the engine speed is in a low speed range. The high speed cam 14 is used to drive the intake valves 20 when the engine speed is in a high speed range. The intermediate speed cam 12 is used to drive the intake valves 20 when the engine speed is in an intermediate speed range.

Each cam 12, 13, 14 has a different cam nose radius to obtain different valve timings and different valve lifts. When the intake valves 20 are driven by the low speed cam 13, the opening timing of the intake valves 20 is retarded and the closing timing is advanced in comparison with those of the high speed cam 14. Furthermore, the valve lift is decreased. When the intake valves 20 are driven by the intermediate speed cam 12, the valve timing is between the valve timings of the low speed cam 13 and the high speed cam 14. Furthermore, the valve lift of the intermediate speed cam 12 is between the valve lifts of the low speed cam 13 and the high speed cam 14.

A rocker shaft 15 extends parallel to the camshaft 11. A rocker arm 16 is pivotally secured to the rocker shaft 15. A roller 17 is rotatably supported on the top middle section of the rocker arm 16. The roller 17 contacts the low speed cam 13. A pair of arms 18 extend from the top middle section of the rocker arm 16. The distal ends of the arms 18 are formed integrally and define an abutment 19. The intake valves 20 are arranged below the abutment 19 and driven by the abutment 19.

A pair of guide bores 21 extend downward from the top surfaces of the left and right portions of the rocker arm 16 (as viewed in FIG. 3).

Two slide bores 24 (refer to FIGS. 3 and 4) extend in a direction perpendicular to the axis of the rocker shaft 15, one is formed in each of the lower left and right portions of the rocker arm 16. The slide bores 24 are connected with the associated guide bores 21. Furthermore, a pair of slide grooves 25 extend along opposite sides of each slide bore 24 in the axial direction of the bore 24. A cam follower 22 is slidably inserted into each guide bore 21. A contact member 23, which contacts the intermediate speed cam 12 or the high speed cam 14, is defined on the distal end of each cam follower 22.

Figure 1:
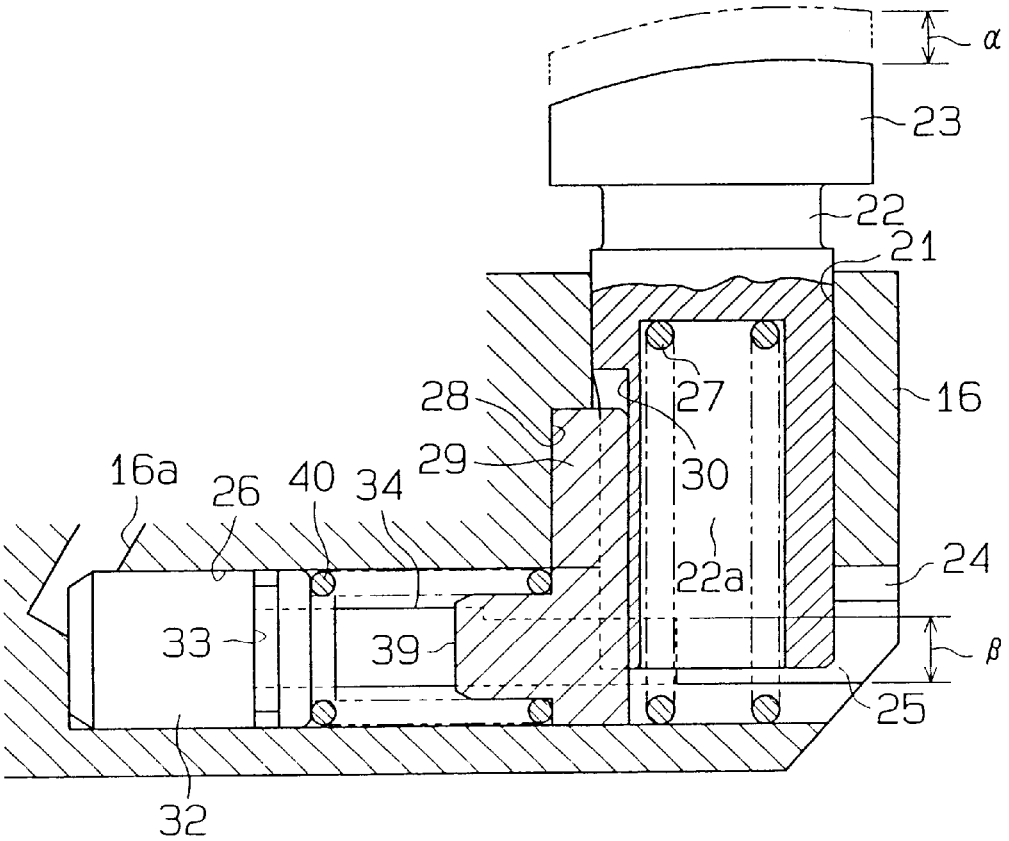
FIG. 1(*a*) is a cross-sectional side view showing a valve performance control apparatus according to a first embodiment of the present invention with the lock member unlocked.
Figure 1:
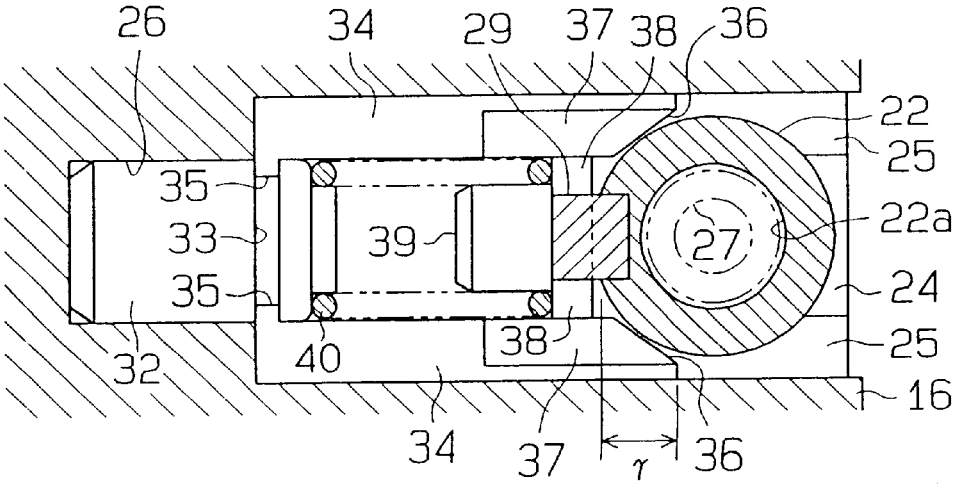
Figure 5:
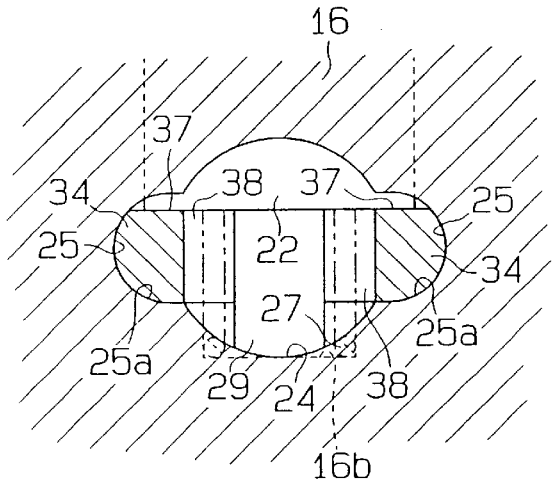
FIG. 5 is a cross-sectional view of the slide bore.
Figure 6:
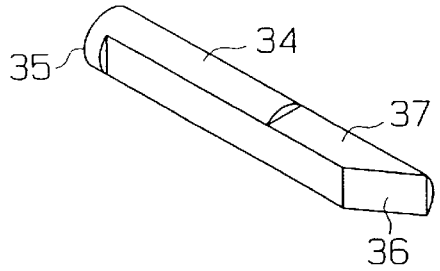
FIG. 6 is a perspective view of a lock member.

As shown in FIG. 1(*a*), a central bore 22*a* is formed in each cam follower 22. A coil spring 27 is accommodated in each central bore 22*a*. The lower end of the coil spring 27 abuts against the wall of the slide bore 24, while the upper end of the spring 27 abuts against the top surface of the central bore 22*a*. Thus, the coil spring 27 urges the cam follower 22 upward. The force of the coil spring 27 is weaker than the force of another spring (not shown) that urges the intake valves 20 upward. As shown in FIG. 5, a cylindrical recess 16*b* is defined in the bottom surface of each slide bore 24 to receive the lower end of the coil spring 27.

As shown in FIG. 1(*a*), a keyway 28 extends axially along the wall of each guide bore 21. A key 29 is fitted into each keyway 28. A receiving groove 30 is provided in the outer surface of each cam follower 22. Each key 29 is slidably received in the associated receiving groove 30. This restricts the rotation of each cam follower 22 in the associated guide bore 21.

As shown in FIGS. 1(*a*) and 1(*b*), a hydraulic pressure chamber 26 is defined in the proximal end of each slide bore 24. The shape and cross-sectional diameter of the pressure chamber 26 is the same as that of the slide bore 24. In addition, the pressure chamber 26 is coaxial with the slide bore 24. The pressure chamber 26 corresponding to the intermediate speed cam 12 is connected to an oil pump (not shown) by an oil passage 16*a* extending through the rocker arm 16, a oil passage 15a extending through the rocker shaft 15 (FIG. 3), and an electromagnetic valve (not shown). The pressure chamber 26 corresponding to the high speed cam 12 is connected to the oil pump by a further oil passage (not shown) extending through the rocker arm 16, a further oil passage (not shown) extending through the rocker shaft 15 (FIG. 3), and the electromagnetic valve.

The oil passage (one of which is designated as 15*a*) extending through the rocker shaft 15 is separated from each other by a partition (not shown). The pressure chamber 26 corresponding to the intermediate speed cam 12 is supplied with hydraulic oil sent through the left oil passage 15*a* (FIG. 3). The pressure chamber 26 corresponding to the high speed cam 12 is supplied with hydraulic oil sent through the right oil passage 15*a* (FIG. 3). In other words, hydraulic oil is supplied to each pressure chamber 26 through a different passage.

A cylindrical piston 32 is accommodated in each pressure chamber 26. An annular groove 33 extends about the peripheral surface near one end of the piston 32.

Figure 2A:
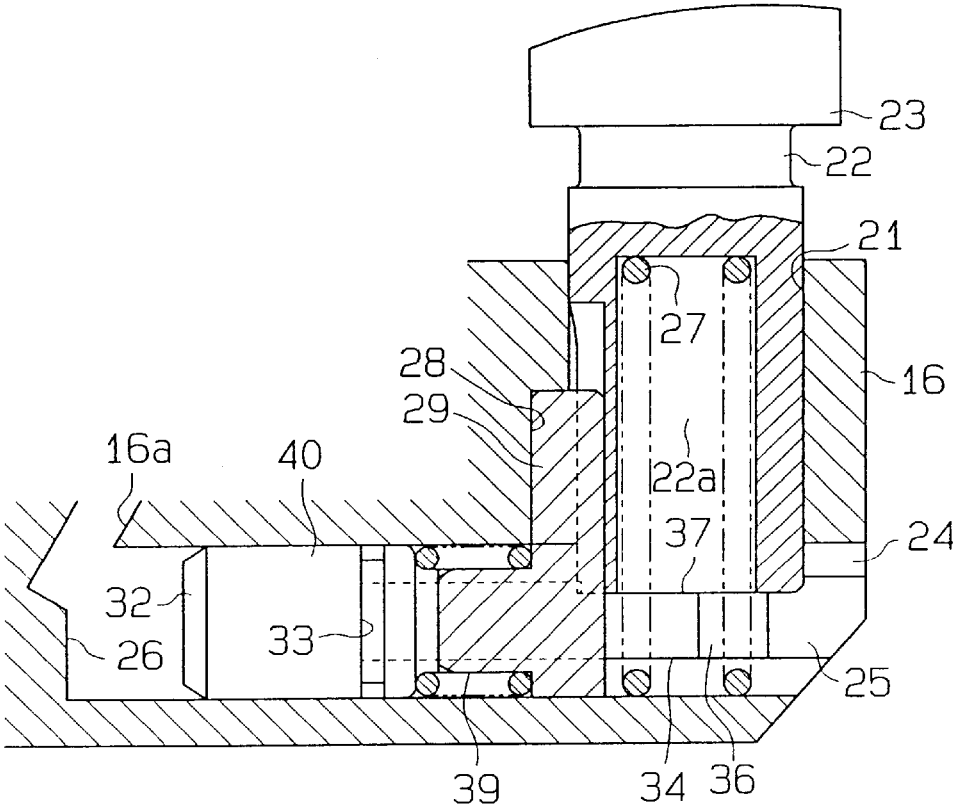
FIG. 2(*a*) is a cross-sectional side view showing the valve performance control apparatus with the lock member locked.
Figure 2B:
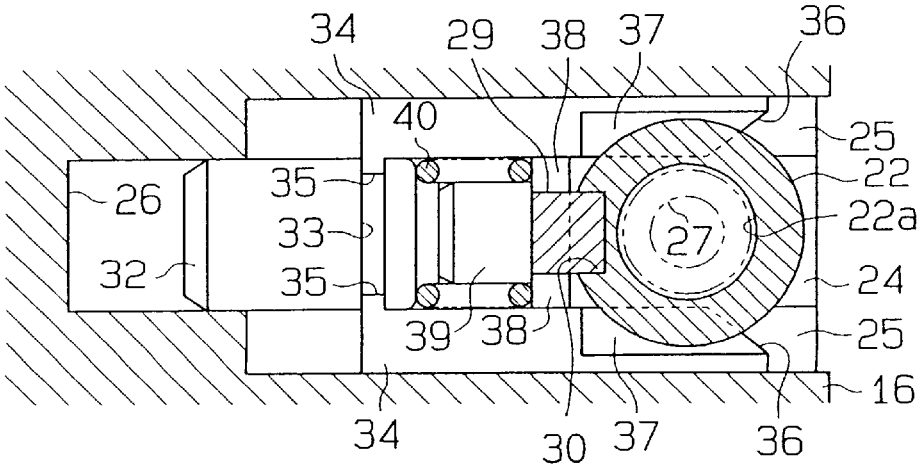

A lock member 34 is slidably received in each sliding groove 25. An engaging portion 35 (FIG. 6) defined on the proximal end of each lock member 34 is engaged with the annular groove 33 of the associated piston 32. Thus, when the piston 32 reciprocates axially in the associated pressure chamber 26, the lock members 34 move integrally with the piston 32. The lock members 34 move between an unlocked position, in which they are out of the path of the associated cam follower 22, as shown in FIG. 1(*a*), and a locked position, in which they are located in the path of the cam follower 22, as shown in FIG. 2(*a*). When the lock members 34 are moved to the unlocked position, movement of the cam follower 22 with respect to the rocker arm 16 is permitted. When the lock members 34 are moved to the locked position, the lock members 34 abut against the bottom surface of the cam follower 22 and lock the cam follower 22 to the rocker arm 16.

As shown in FIGS. 1(*b*) and 6, each lock member 34 has a flat side surface and an inclined surface 36, which is provided at the distal end of the lock member 34. Each lock member 34 also has a flat abutment surface 37 defined on its upper surface at the end opposite to the piston 32. As shown in FIG. 1(*a*), the vertical dimension β of the lock members at the abutment surface 37 is greater than the stroke a of the cam follower 22.

Figure 7:
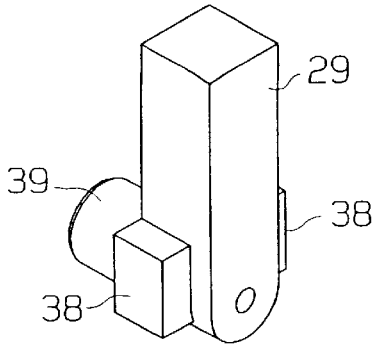
FIG. 7 is a perspective view of a key.
Figure 8:
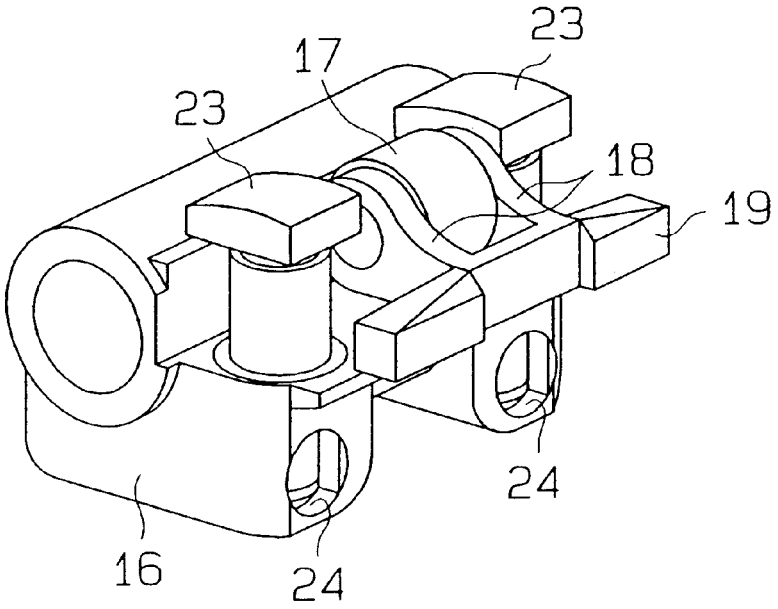
FIG. 8 is a perspective view of a valve performance control apparatus according to a second embodiment of the present invention without the cam.

As shown in FIG. 7, a restriction 38 projects from each side of the lower portion of each key 29. The end face of each restriction 38 is flat and slides along the flat side surface of the associated lock member 34. The restriction 38 supports the lock member 34 so that the lock member 34 does not fall out of the associated slide groove 25.

A cylindrical spring receptor 39 projects from the lower portion of each key 29 to face the associated piston 32. A coil spring 40 is arranged between the spring receptor 39 and the piston 32. The coil spring 40 constantly urges the key 29 and the piston 32 away from each other.

The operation of the above valve performance control apparatus will now be described.

FIGS. 1(*a*) and 1(*b*) show the valve performance control apparatus when the engine speed is in a low range. FIGS. 1(*a*) and 1(*b*) show the cam follower 22 that corresponds to the high speed cam 14. In this state, the supply of hydraulic oil from the oil pump to the pressure chamber 26 is stopped. Thus, the force of the coil spring 40 urges the piston 32 against the end wall of the pressure chamber 26. Accordingly, the lock members 34 are removed from the path of the cam follower 22 and located at the unlocked position. As a result, the cam follower 22 is not locked by the lock members 34.

In this state, the high speed cam 14 moves the contact member 23 of the cam follower 22 and drives the cam follower 22 axially between the lower position shown by the solid line in FIG. 1(*a*) and the upper position shown by the dotted line in the same drawing. Thus, the rocker arm 16 is not moved by the high speed cam 14.

Furthermore, with the engine speed in the low range, the supply of hydraulic oil to the pressure chamber 26 corresponding to the intermediate speed cam 12 is also stopped. Therefore, in the same manner as the high speed cam 14, the associated lock members 34 are arranged at the unlocked position, and the rocker arm 16 is not driven by the intermediate speed cam 12.

Accordingly, when the engine speed is in the low range, the low speed cam 13 drives the roller 17 and rocks the rocker arm 16 about the rocker shaft 15 to open and close the associated intake valves 20.

FIGS. 2(*a*) and 2(*b*) show the valve performance control apparatus when the engine speed is in the high range. These drawings show the cam follower 22 corresponding to the high speed cam 14. In this state, the electromagnetic valve permits the flow of hydraulic oil to the pressure chamber 26 through the associated oil passages 16*a*. This moves the piston 32 away from the wall of the pressure chamber 26 against the force of the coil spring 40. As a result, the piston 32 moves the lock members 34 to the locked position and locks the high speed cam follower 22. The shifting of the lock members 34 from the position shown in FIGS. 1(*a*) and 1(*b*) to the position shown in FIGS. 2(*a*) and 2(*b*) takes place when the cam follower 22 is not urged downward by the high speed cam 14 (i.e., when the cam follower 22 is located at the position shown by the dotted line in FIG. 1(*a*)).

When the piston 21 slides in the associated pressure chamber 26, the lock members 34 are guided by the associated restrictions 38 of the key 29. This prevents the lock members 34 from falling out of the slide grooves 25. The abutment surface 37 of each lock member 34 contacts the bottom surface of the cam follower 22 and locks the cam follower 22 with respect to the rocker arm 16. In the state shown in FIGS. 1(*a*) and 2(*a*), which do not show the high speed cam 14, the contact member 23 always contacts the high speed cam 14. Thus, the cam follower 22 never moves above the position shown by the solid line in FIG. 2(*a*).

In the high speed range, the high speed cam 14 forces the bottom surface of the associated cam follower 22 against the lock members 34 and integrally rocks the rocker arm 16 with the cam follower 22. This opens and closes the associated intake valves 20.

In the high speed range, the oil pump additionally supplies the pressure chamber 26 corresponding to the intermediate speed cam 12 with hydraulic oil through the associated oil passages 15*a*, 16*a*. Therefore, in the same manner as with the high speed cam 14, the associated lock members 34 are in their locked positions and the intermediate speed cam follower 22 is locked to the rocker arm 16. However, since the cam nose radius of the intermediate speed cam 12 is smaller than the cam nose radius of the high speed cam 14, the intermediate speed cam 12 does not control the rocker arm 16.

When the engine speed is in the intermediate range, hydraulic oil is supplied to the pressure chamber 26 corresponding to the intermediate speed cam 12 but not to the pressure chamber 26 corresponding to the high speed cam 14. Thus, the lock members 34 corresponding to the intermediate speed cam 12 are moved to their locked positions while the lock members 34 corresponding to the high speed cam 14 are moved to their unlocked positions. In this state, the rocker arm 16 is driven by the intermediate speed cam 12 and not the high speed cam 14. The intermediate speed cam 12 forces the cam follower 22 against the associated lock members 34 and rocks the rocker arm 16 integrally with the cam follower 22 to open and close the associated intake valves 20.

When the intermediate speed cam 12 or the high speed cam 14 is forced against the associated cam follower 22, the cam follower 22 presses the associated lock members 34. As shown in FIG. 5, each lock member 34 is entirely supported by the lower surface 25*a* of the associated slide groove 25. Since each lock member 34 is supported by the lower surface 25*a* of the slide groove 25 when pressed by the cam follower 22, there is no shearing force acting on the lock member 34. In other words, the lower support surface 25*a* intersects with an axial projection of the cam follower 22. Thus, the lock member 34 is not subject to bending or shear.

Most of the force applied to the lower surface 25*a* of each slide groove 25 by the associated lock member 34 is received by the rocker arm 16. The lower surface 25*a* has an arcuate cross-section. Thus, a component of the pressing force applied to the lower surface 25*a* by the lock member 34 further acts to press the lock member 34 against the restriction 38 of the associated key 29. As shown in FIG. 5, the restrictions 38 of each key 29 are symmetrical about a vertical plane. Furthermore, the lock members 34 in each set of slide grooves 25 are symmetrical about the same vertical plane. Accordingly, each restriction 38 receives an equal force from the associated lock member 34. Therefore, the keys 29 are not deformed by the pressing forces.

When shifting from the state shown in FIGS. 2(*a*) and 2(*b*) to the state shown in FIGS. 1(*a*) and 1(*b*), the electromagnetic valve stops the flow of hydraulic oil from the oil pump. This causes the coil spring 40 to move the piston 32 until the piston 32 abuts against the wall of the pressure chamber 26. Accordingly, the lock members 34 are moved out of the path of the cam follower 22 to their unlocked positions. As a result, the intermediate speed cam 12 and the high speed cam 14 do not drive the rocker arm 16, although they move the associated cam follower 22 axially with respect to the rocker arm 16.

The advantages of the present invention will now be described.

Each lock member 34 is formed by machining a metal cylinder. The slide groove 25 that accommodates each lock member 34 has a semispherical cross-section. Accordingly, the machining of the lock member 34 is simplified and the installation of the lock members 34 in the rocker arm 16 is facilitated.

Each lock member 34 is supported entirely by the lower surface 25*a* of the associated slide groove 25. In other words, the lock members 34 are entirely supported by the rocker arm 16. Thus, the lock members 34 are pressed against the lower surface 25*a* of the slide grooves 25 by the associated cam followers 22 and are not subjected to a shear force. Accordingly, the cross-sectional area of each lock member 34 need not be increased to provide high shear strength. As a result, the lock members 34 are smaller and lighter as compared with the prior art.

Each lock member 34 has the engaging portion 35 that engages the associated piston 32. The engagement between the engaging portion 35 and the piston 32 moves the piston 32 and the lock member 34 integrally. This structure simplifies the connection between the lock member 34 and the piston 32. As a result, the number of parts is reduced as compared to the prior art.

The distal end of each lock member 34 is provided with the inclined surface 36. Thus, as shown in FIG. 1(*b*), when the lock members 34 are arranged in their unlocked positions, part of the associated cam follower 22 remains between the lock members 34. In other words, as shown in FIG. 1(*b*), part of the lock members 34 and part of the cam follower 22 are overlapped in the moving direction of the lock members 34 by distance γ. This minimizes the dimension along which the cam followers 34 and the associated lock members 34 are arranged in comparison to a device where the inclined surfaces 36 are not provided. Furthermore, the distance between the locked position and the unlocked position of the lock members 34 is minimized.

If the inclined surfaces 36 were not provided, the lock members 34 and the cam follower 22 could not be overlapped. That is, the distance required for the arrangement of the cam follower 22 and the lock members 34 is shorter when employing lock members 34 with the inclined surfaces 36 by distance γ. Eliminating the inclined surfaces 36 would increase the distance between the locked position and the unlocked position of the lock members 34 by at least distance γ.

A second embodiment according to the present invention will now be described with respect to FIGS. 8 to 11. In this embodiment, components that are like or same as corresponding components of the first embodiment are denoted with the same reference numerals.

In this embodiment, a cylindrical cam follower 22 is slidably inserted into a guide tube 42, which is fixed in a guide bore 21. A coil spring 43 encompasses the peripheral surface of the guide tube 42 between a contact member 23 of the cam follower 22 and the upper surface of the rocker arm 16. Like the coil spring 27 employed in the first embodiment, the urging force of the coil spring 43 is weaker than the urging force of a spring (not shown) that urges the associated intake valves 20 upward. The bottom surface of the guide tube 42 is flush with the upper portion of the associated slide groove 24. That is, the guide tube 42 does not extend into the associated slide groove 24.

Figure 9A:
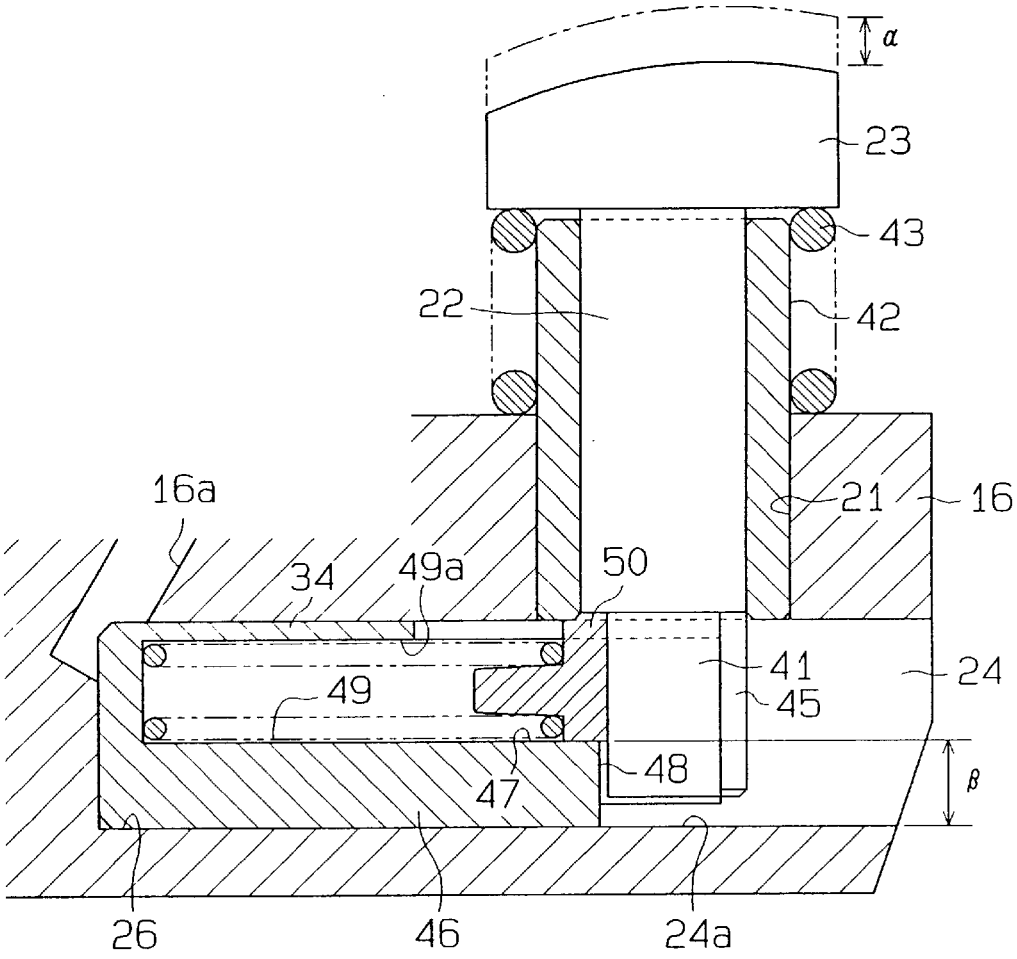
FIG. 9(*a*) is a cross-sectional side view showing the valve performance control apparatus of FIG. 8 with the lock member unlocked.
Figure 9B:
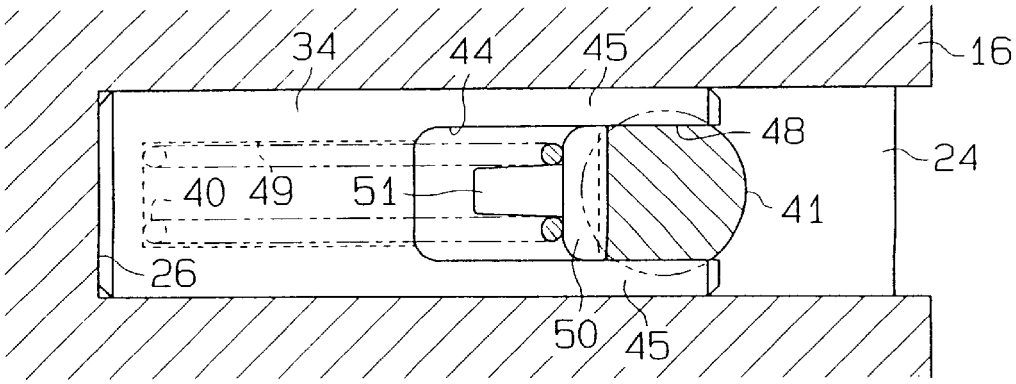

As shown in FIG. 9(*b*), an abutment leg 41 projects from the bottom of the cam follower 22. The leg 41 has two parallel, planar surfaces that are parallel to the axis of the slide bore 24 and one planar surface facing toward the pressure chamber 26.

Figure 11:
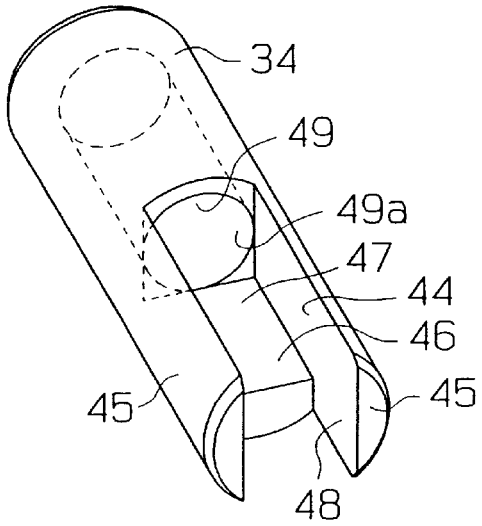
FIG. 11 is a perspective view showing the lock member of FIG. 10(*b*)
Figure 12:
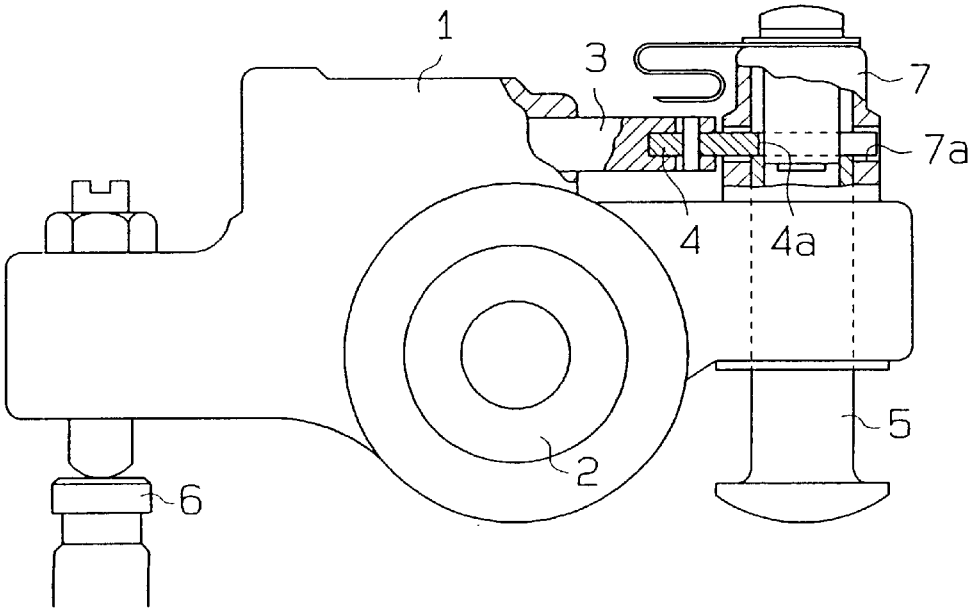
Fig.12(Prior Art)
FIG. 12 is a partial cross-sectional view showing a prior art apparatus.

The slide grooves 25 of the first embodiment are not provided in the second embodiment. A slide bore 24, which has a circular cross-section, is formed for each cam follower 22 in the rocker arm 16. A cylindrical lock member 34 is slidably accommodated in the slide bore 24. The proximal portion of the lock member 34 functions as a piston while the distal portion of the lock member 34 serves to lock the associated cam follower 22. A hydraulic pressure chamber 26 is defined between the end wall of the slide bore 24 and the proximal end surface of the lock member 34. As shown in FIG. 11, a longitudinal groove 44 is formed in the lock member 34. The groove 44 is defined between a pair of side pieces 45 and extends to the axially middle section of the lock member 34. An abutment 46 extends between the lower portions of the side pieces 45. A flat abutment surface 47 is defined on the upper surface of the abutment 46. The abutment 46 is axially shorter than the side pieces 45. This defines an opening 48 at the distal end of the abutment 46.

As shown in FIG. 9(*b*), the leg 41 of the cam follower 22 is always held in between and in contact with the side pieces 45. The cam follower 22 moves vertically with its leg 41 held between the side pieces 45. The lock member 34 moves reciprocally in the slide bore 24 with its side pieces 45 holding the leg 41 in between. The engagement between the leg 41 and the side pieces 45 restricts the rotation of the cam follower 22 in the guide tube 42. The inner surfaces of the side pieces 45 that define the opening 48 are flat and extend continuously from the inner surfaces of the side pieces 45 that define the engaging groove 44.

Figure 10A:
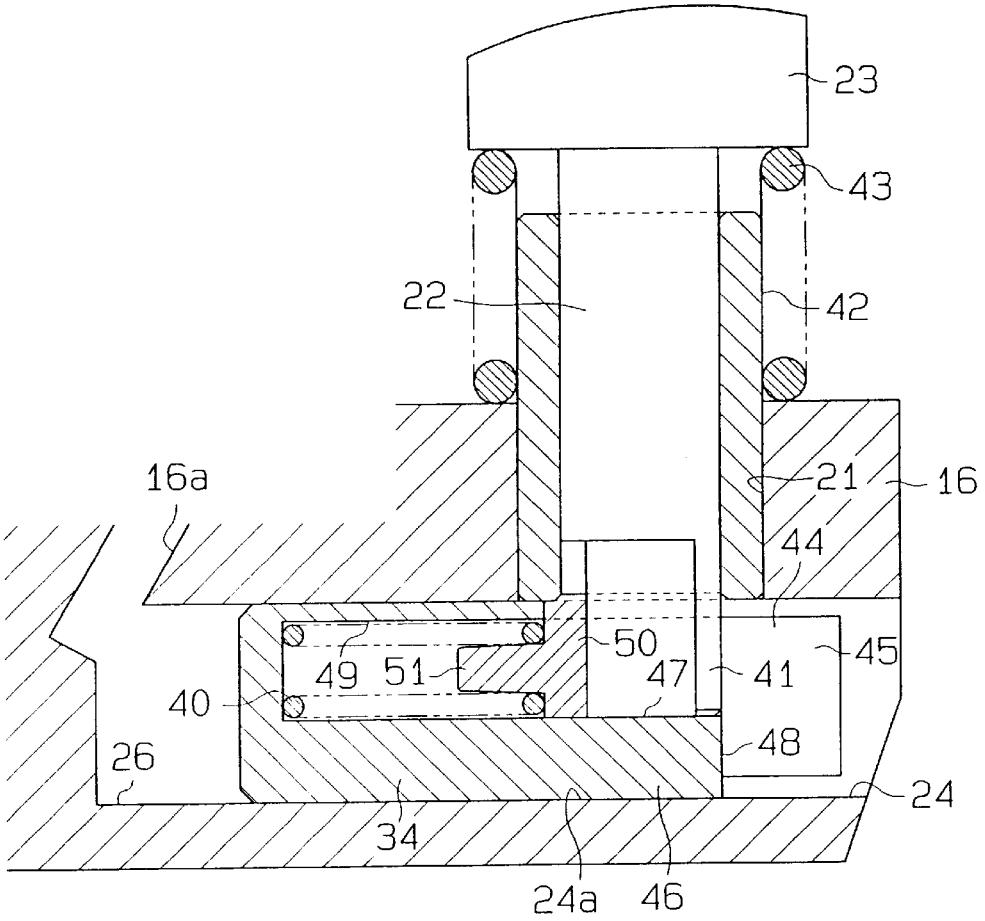
FIG. 10(*a*) is a side cross-sectional view showing the valve performance control apparatus of FIG. 8 with the lock member locked.
Figure 10B:
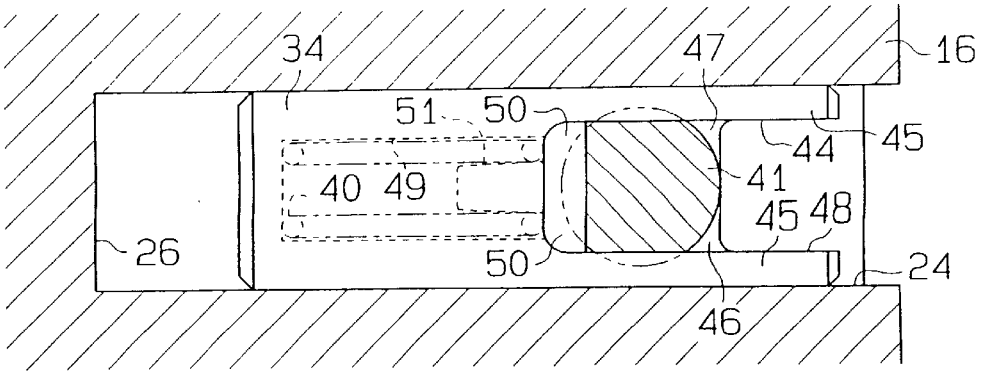

The lock member 34 is provided with a spring accommodating bore 49 that is connected with the engaging groove 44 and extends along the axis of the lock member 34. A spring receptor 50 contacting the leg 41 is retained in the engaging groove 44. As shown in FIG. 10(*a*), the spring receptor 50 is large enough to close the inlet 49*a* of the accommodating bore 49. The spring receptor 50 slides along the abutment surface 47 of the abutment portion 46 while in contact with the inner surfaces of the side pieces 45. A truncated cone-like engaging projection 51 projects from the spring receptor 50. A coil spring 40 is accommodated in the accommodating bore 49. One end of the coil spring 40 is fitted to the engaging projection 51 while the other end of the spring 40 abuts against the end wall of the accommodating bore 49. The coil spring 40 constantly urges the lock member 34 toward the pressure chamber 26.

As shown in FIG. 9(*a*), the vertical dimension β of the abutment portion 46 is greater than the stroke α of the cam follower 22 when the cam follower 22 is in an unlocked state.

The operation of the second embodiment will now be described.

FIGS. 9(*a*) and 9(*b*) show the valve performance control apparatus when the engine speed is in a low range. In these drawings, the cam follower 22 that corresponds to the high speed cam 14 is shown. In this state, the supply of hydraulic oil from the oil pump to the pressure chamber 26 is stopped. Thus, the force of the coil spring 40 abuts the lock member 34 against the end wall of the pressure chamber 26. Accordingly, the lock member 34 is separated from the path of the cam follower 22 and is located at the unlocked position. As a result, the cam follower 22 is not locked by the lock member 34.

In this state, the high speed cam 14 moves the contact member 23 of the cam follower 22 and drives the cam follower 22 vertically between the lower position shown by the solid line in FIG. 9(*a*) and the upper position shown by the dotted line in the same drawing. Thus, the rocker arm 16 is not moved by the high speed cam 14.

Furthermore, with the engine speed in the low range, the supply of hydraulic oil to the pressure chamber 26 corresponding to the intermediate speed cam 12 is also stopped. Therefore, in the same manner as the high speed cam 14, the associated lock member 34 is arranged at the unlocked position and the rocker arm 16 is not driven by the intermediate speed cam 12.

Accordingly, when the engine speed is in the low speed range, the low speed cam 13 presses the roller 17 and rocks the rocker arm 16 about the rocker shaft 15 to open and close the associated intake valves 20.

FIGS. 10(*a*) and 10(*b*) show the valve performance control apparatus when the engine speed is in the high range. These drawings show the cam follower 14 corresponding to the high speed cam 14. In this state, the electromagnetic valve permits the flow of hydraulic oil to the pressure chamber 26 through the associated oil passage 16*a*. This moves the lock member 34 away from the end wall of the pressure chamber 26 against the force of the coil spring 40. As a result, the lock member 34 moves to the locked position and locks the cam follower 22. The shifting of the lock member 34 from the position shown in FIGS. 9(*a*) and 9(*b*) to the position shown in FIGS. 10(*a*) and 10(*b*) takes place when the cam follower 22 is not moved downward by the high speed cam 14 (i.e., when the cam follower 22 is located at the position shown by the dotted line in FIG. 1(*a*)).

When in the high speed range, the lock member 34 slides in the associated slide bore 24 with the walls of the engaging groove 44 remaining in contact with the leg 41 of the cam follower 22. Furthermore, the bottom surface of the leg 41 abuts against the abutment surface 47 of the abutment portion 41. Thus, the lock member 34 locks the cam follower 22. In the state shown in FIGS. 9(*a*) and 10(*a*), which do not show the high speed cam 14, the contact member 23 is always in contact with the high speed cam 14. Thus, the cam follower 22 never moves above the position shown by the solid line in FIG. 10(*a*).

When the high speed cam 14 drives the cam follower 22, the abutment of the bottom surface of the cam follower 22 against the lock member 34 causes the rocker arm 16 to rock integrally with the cam follower 22. This opens and closes the associated intake valves 20.

In the high speed range, the oil pump supplies the pressure chamber 26 corresponding to the intermediate speed cam 12 with hydraulic oil through the associated oil passages 15*a*, 16*a* in the same manner as the first embodiment. Therefore, the associated lock member 34 is arranged at the locked position and the intermediate speed cam follower 22 is also locked to the rocker arm 16.

When the engine speed is in an intermediate range, hydraulic oil is supplied to the pressure chamber 26 corresponding to the intermediate speed cam 12 but not to the pressure chamber 26 corresponding to the high speed cam 14. Thus, the lock member 34 corresponding to the intermediate speed cam 12 is moved to the locked position. As a result, the intermediate speed cam 12 rocks the rocker arm 16 integrally with the cam follower 22 and opens and closes the associated intake valves 20.

When the intermediate speed cam 12 or the high speed cam 14 moves the associated cam follower 22, the cam follower 22 is forced against the associated lock member 34. As shown in FIG. 10(*a*), the lock member 34 is entirely supported by the lower surface 24*a* of the associated slide bore 24. Since the lock member 34 is supported by the lower surface 24*a* of the slide groove 25 when pressed by the cam follower 22, there is no shear force acting on the lock member 34. That is, the lower surface 24*a* intersects an axial projection of the cam follower 22. This prevents bending or shear on the lock member 34.

When shifting from the state shown in FIGS. 10(*a*) and 10(*b*) to the state shown in FIGS. 9(*a*) and 9(*b*), the electromagnetic valve stops the flow of hydraulic oil from the oil pump. This causes the coil spring 40 to move the lock member 34 until the lock member 34 abuts against the end wall of the pressure chamber 26. Accordingly, the lock member 34 is moved out of the path of the cam follower 22 and to the unlocked position. As a result, the intermediate speed cam 12 and the high speed cam 14 do not drive the rocker arm 16, although they press the contact members 23 of the associated cam follower 22 and move the cam follower axially with respect to the rocker arm 16.

The advantages of the second embodiment will now be described.

Each lock member 34 is formed by machining a simple cylindrical rod. The slide bore 24 that accommodates the lock member 34 has a circular cross-section. Accordingly, the machining of the lock member 34 is simplified and the installation of the lock member 34 in the rocker arm 16 is facilitated. Furthermore, the slide bores 24 do not have the slide grooves 25. Thus, the rocker arm 16 need not be machined to form the slide grooves 25.

In the second embodiment, the lock member 34 combines the function of a cam follower 22 lock and the function of a piston. Thus, in comparison with the first embodiment, which employs a piston in addition to the lock member 34, the structure of the second embodiment reduces the number of parts and the number of assembly steps, which decreases production costs.

Each lock member 34 is supported entirely by the lower surface 24*a* of the associated slide bore 24. In other words, the lock member 34 is entirely supported by the rocker arm 16. Since each lock member 34 is pressed against the lower surface 24*a* of the slide bore 24 by the associated cam follower 22, the lock member 34 is not subjected to shear force. Accordingly, in the same manner as the first embodiment, the cross-sectional area of the lock member 34 need not be increased to resist shearing. As a result, a more compact and light lock member 34 can be employed in the valve performance control apparatus.

The leg 41 of each lock member 34 is held between the side pieces 45 of the lock member 34 to restrict the rotation of the associated cam follower 33 in the guide tube 42. Thus, additional components used to restrict the rotation of the cam follower 22 such as the key 29 in the first embodiment are not necessary. This reduces the number of parts and decreases production costs.

It should be apparent to those skilled in the art that the present invention may be embodied in many other specific forms without departing from the spirit or scope of the invention. More particularly, the present invention may be modified as described below.

In the first and second embodiments, the present invention is embodied in an apparatus that controls the performance of intake valves 20. However, the present invention may also be embodied in an apparatus that controls the performance of exhaust valves or one that controls both the intake and exhaust valves.

In the first embodiment, the piston 32 and the associated lock members 34 may be formed integrally.

In the first embodiment, the coil spring 27 is accommodated in the cam follower 22. In the same manner, the coil spring 43 may be accommodated in the cam follower 22 in the second embodiment.

The slide bore 24 and the slide groove 25 of the first embodiment and the slide bore 24 of the second embodiment all have circular cross-sections. However, the cross-sections of these elements may have other forms. For example, the cross-sections may be rectangular or elliptic. In this case, the shape of the piston 34 and the lock member 34 must conform with the cross-sections of the associated bore or groove.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling valve performance in an engine, the engine including a valve for opening and closing a combustion chamber, the valve being variably actuated so that at least one of a valve lift amount and a valve timing is varied, the apparatus comprising:

a plurality of cams for selectively opening and closing the valve, the cams including a first cam and a second cam, the first cam having a profile differing from a profile of the second cam;

a rocker arm arranged between the cams and the valve, the rocker arm having a contacting member for contacting the first cam;

a guide bore formed in the rocker arm and having an axis;

a cam follower reciprocally supported in the guide bore to contact the second cam, wherein the cam follower has an axis aligned with the axis of the guide bore and is capable of reciprocating movement in an axial direction;

a lock member supported in the rocker arm and movable in a direction transverse to the axis of the cam follower, the lock member having an abutment surface movable between a first position spaced from the path of the cam follower and a second position located in the path of the cam follower, the lock member being disposed in the first position to permit reciprocation of the cam follower with respect to the rocker arm so that the valve is driven by the first cam through the rocker arm, and the lock member being disposed in the second position so that the lock member abuts against the cam follower and locks the cam follower to the rocker arm to drive the valve by the second cam through the cam follower and the rocker arm; and a supporting surface on the rocker arm to support the lock member when the lock member is positioned in the second position and is pressed by the cam follower, the supporting surface being opposed to the abutment surface of the lock member, wherein the supporting surface lies in an axial projection of the guide bore such that, when the lock member is in the second position, force is transmitted from the cam follower to the supporting surface through the lock member in the axial direction of the cam follower.

2. The apparatus according to claim 1, wherein the profile of the first cam is generally smaller than the profile of the second cam, the lock member being positioned in the first position to drive the valve by the first cam when the engine speed is in a low range, and the lock member being positioned in the second position to drive the valve by the second cam when the engine speed is in a high range.

3. The apparatus according to claim 1, wherein the rocker arm includes a pressure chamber to receive hydraulic fluid pressure for actuating the lock member, the lock member being moved to the second position when the hydraulic fluid pressure is supplied to the pressure chamber, and the lock member being moved to the first position when the pressure of hydraulic fluid supplied to the pressure chamber is lower than a predetermined level.

4. The apparatus according to claim 3, further comprising a piston accommodated in the pressure chamber.

5. The apparatus according to claim 4, wherein the piston is formed integrally with the lock member.

6. The apparatus according to claim 1, wherein the rocker arm defines a bore having a circular cross-section for slidably accommodating the lock member, and a wall of the bore serves as the supporting surface.

7. The apparatus according to claim 6, wherein the lock member is formed by forming a flat surface on a cylindrical member, the flat surface forming the abutment surface.

8. The apparatus according to claim 1 further comprising restricting means arranged between the cam follower and the lock member for restricting rotation of the cam follower about its axis with respect to the rocker arm.

9. The apparatus according to claim 8, wherein the restricting means includes a pair of flat surfaces formed on the cam follower so as to be parallel with the moving direction of the lock member, the lock member including a plurality of holding pieces to sandwich the cam follower therebetween.

10. An apparatus for controlling valve performance in an engine, the engine including a valve for opening and closing a combustion chamber, the valve being variably actuated so that at least one of a valve lift amount and a valve timing is varied, the apparatus comprising:

a plurality of cams for selectively opening and closing the valve, the plurality of cams including a first cam and a second cam, the first cam having a profile differing from a profile of the second cam, the profile of the first cam being generally smaller than the profile of the second cam;

a rocker shaft;

a rocker arm rotatably supported on the rocker shaft between the cams and the valve, the rocker arm having a contacting member for contacting the first cam;

a cam follower reciprocally supported in the rocker arm to contact the second cam, wherein the cam follower has an axis and is capable of reciprocating movement in an axial direction;

a lock member supported in the rocker arm to be movable in a direction substantially perpendicular to the axis of the cam follower, the lock member having an abutment surface movable between a first position spaced from the path of the cam follower and a second position located in the path of the cam follower, the lock member being disposed in the first position to permit the reciprocation of the cam follower with respect to the rocker arm so that the valve is driven by the first cam through the rocker arm, and the lock member being disposed in the second position so that the lock member abuts against the cam follower and locks the cam follower to the rocker arm to drive the valve by the second cam through the cam follower and the rocker arm; and the rocker arm having a bore for slidably accommodating the lock member, the bore having a supporting wall for supporting the lock member when the lock member is in the second position and is pressed by the cam follower, the supporting wall being located in opposed relation to the abutment surface of the lock member, wherein the supporting wall lies in an axial projection of the cam follower such that, when the lock member is in the second position, force is transmitted from the cam follower to the supporting wall through the lock member in the axial direction of the cam follower.

11. The apparatus according to claim 10, wherein the lock member in the first position drives the valve by the first cam when the engine speed is in a low range, and the lock member in the second position drives the valve by the second cam when the engine speed is in a high range.

12. The apparatus according to claim 11, wherein the rocker arm includes a pressure chamber to be supplied with hydraulic fluid pressure for actuating the lock member, the lock member being moved to the second position when the hydraulic fluid pressure is supplied to the pressure chamber, and the lock member being moved to the first position when the pressure of hydraulic fluid supplied to the pressure chamber is lower than a predetermined level.

13. The apparatus according to claim 12 further comprising a piston accommodated in the pressure chamber.

14. The apparatus according to claim 13, wherein the piston is formed integrally with the lock member.

15. The apparatus according to claim 12, wherein the bore has a circular cross-section, and the lock member is formed by forming a flat surface on a cylindrical member, the flat surface forming the abutment surface.

16. The apparatus according to claim 12 further comprising restricting means arranged between the cam follower and the lock member for restricting rotation of the cam follower about its axis with respect to the rocker arm.

17. The apparatus according to claim 16, wherein the restricting means includes a pair of flat surfaces formed on the cam follower to be parallel to the moving direction of the lock member, the lock member having a pair of holding pieces to sandwich the cam follower therebetween.

* * * * *